US005906028A

United States Patent [19]

Whisman et al.

[11] Patent Number: 5,906,028

[45] Date of Patent: May 25, 1999

[54] HINGE ASSEMBLY FOR AN EXPANDABLE PERFORMANCE PLATFORM

[75] Inventors: William M. Whisman; Albert L. Hearne, both of Springville, Calif.

[73] Assignee: Portable Entertainment Platforms Co., Springville, Calif.

[21] Appl. No.: 09/035,323

[22] Filed: Mar. 5, 1998

[51] Int. Cl.[6] ..... E05D 5/02; E05D 15/00

[52] U.S. Cl. ..... 16/252; 16/241; 16/265; 16/268; 16/382; 16/244; 296/26.15; 403/68

[58] Field of Search ..... 16/244, 252, 253, 16/235, 239, 240, 241, 246, 248, 223, 262, 265, 267, 268, 361, 366, 382; 108/67, 69, 166, 171; 296/26.03, 26.11, 26.15; 403/52, 68, 69

[56] References Cited

U.S. PATENT DOCUMENTS

| | | | |
|---|---|---|---|
| 610,243 | 9/1898 | Reno | 16/265 |
| 3,295,158 | 1/1967 | Hotchkiss, Jr. et al. | 16/252 |
| 4,243,105 | 1/1981 | Vogel et al. | 16/233 |
| 5,029,363 | 7/1991 | Hesener | 16/241 |
| 5,417,015 | 5/1995 | Coyne | 16/382 |
| 5,649,734 | 7/1997 | Speis | 296/26.15 |

*Primary Examiner*—Chuck Y. Mah

*Attorney, Agent, or Firm*—Patrick J. Pinto

[57] ABSTRACT

A hinge assembly for use with an expandable performance platform that allows relative independent pivotal movement between its first or extension panels and its adjacent second or base panel. The hinge assembly allows the extension panels to lay atop the base panels for storage or transport by providing movement of the pivot axis as the extension panel is pivoted. The hinge assembly also provides a flat performance area with a minimum of gaps along its abutting edges when the extension panels are in a performance mode.

9 Claims, 3 Drawing Sheets

HINGE ASSEMBLY FOR AN EXPANDABLE PERFORMANCE PLATFORM

BACKGROUND OF THE INVENTION

1. Field of the Invention

With regard to the classification of art, this invention is believed to be found in the general class entitled Miscellaneous Hardware and more particularly to those subclasses pertaining to Hinges that are used with pivotable performance platforms that present a flush finish of adjacent platforms when arrayed in a performance mode.

2. Description of the Related Art

It has been found that there is a need for large performance platforms that are mobile. The platform area of these large performance platforms must be reduced for storage and/or transport. In addition to the need described above, it has been determined that there is a need for the platform area should be free of large gaps between the adjacent performance panels. It has also been determined that the abutment of one panel with another should be substantially flat, meaning that there should be substantially no raised surfaces, steps or objects on the performance area for the safety of the people using the platform.

SUMMARY OF THE INVENTION

The present invention may be summarized with respect to its objects. It is an object of the present invention to provide and it does provide a hinge assembly for expandable performance platforms that allows pivotal movement of one extension or expansion platform with respect to an adjacent base platform. The hinge assembly allows the expansion or extension platforms to be placed in a storage or transport position while also minimizing any gaps between those platforms when they are selectively abutted and arrayed in a performance mode.

It is another object of the present invention to provide and it does provide a hinge assembly for an expandable performance platform that allows relative pivotal moment between one elongated expansion platform and an adjacent elongated base platform while providing a substantially flat performance area when and while the one expansion platform and its adjacent base platform are arrayed in a performance mode.

The present invention may be briefly described as a hinge for an expandable performance platform including: a) a pivot means that includes a pintle portion and at least one leg portion, each leg portion having its axis being disposed transverse to a pivot axis of the pintle portion; b) a leaf member that includes a knuckle portion and an attaching portion, the knuckle portion being sized for allowing the pintle portion to closely fit therein, the attaching portion being arrayed for attaching to a first panel portion; c) at least one frame member for supporting at least one edge of a second panel portion, the frame member including a first leg, a second leg, and a guiding means, the first leg and second leg being formed with an L-shaped cross-section, the guiding means including a guiding axis and having a predetermined length, the guide means being disposed at a selected angle with respect to the first leg of the frame member for guiding said leg portion of the pivot means through a corner formed at an intersection of the first leg and second leg; and wherein said pivoting means being further arrayed for providing a stepless and flush abutment of the first panel with the second panel when placed in a performance position, the first panel and second panel also having a minimum space therebetween when placed in the performance position, the leg portion is slidably displaced or moved along the guiding axis of the guide means from a first position to a second position when and as the first panel is pivoted with respect to the second panel to a stored position while simultaneously displacing the pivot axis of the pintle portion thereby allowing a face of the first panel to abut a face of the second panel in the stored position. The pivot means preferably includes a stop member for limiting the displacement of the leg portion within the guide means. The hinge may also include a biasing means that is mounted between a selected surface of the guide means and a stop means.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode of the present invention. These specific embodiments, as shown in the accompanying drawings, may also include diagrammatic symbols for the purpose of illustration and understanding.

Figure 2:
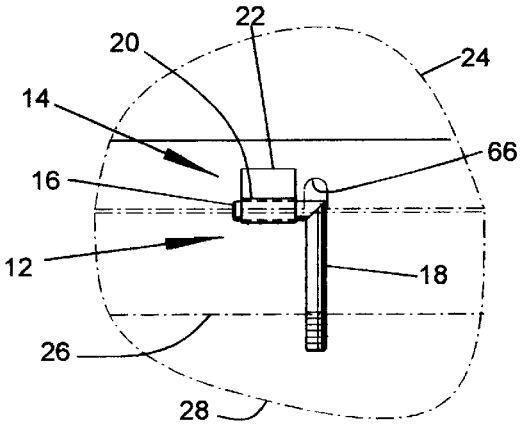
FIG. 2 represents a fragmentary plan view of one embodiment of a pivot means of the present invention.

In the following description and in the appended claims, various details are identified by specific names for convenience. These names are intended to be generic in their application while differentiating between the various details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Figure 3:
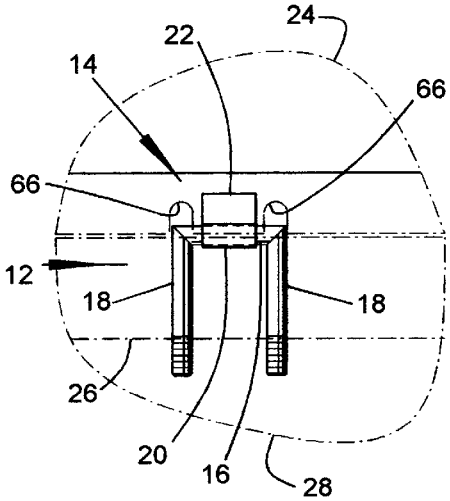
FIG. 3 represents a fragmentary plan view of an alternate embodiment of a pivot means of the present invention.
Figure 1:
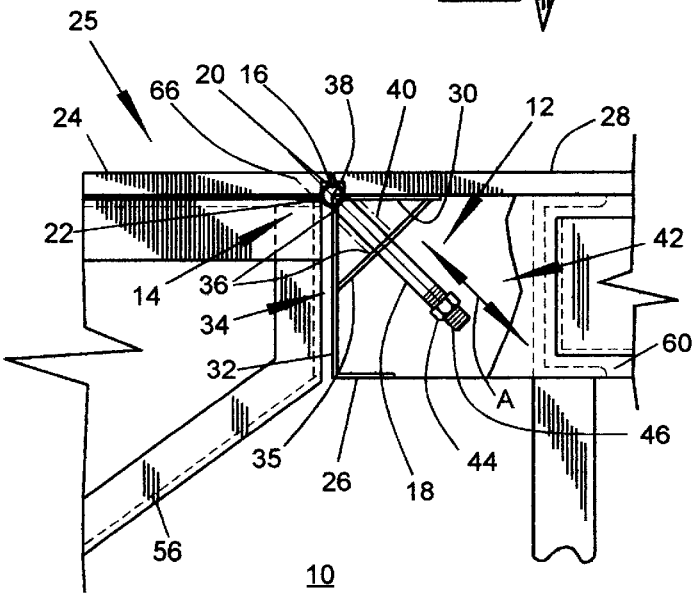
FIG. 1 represents a side elevation of a hinge assembly of the present invention. This view being fragmentary and showing a portion of a platform frame for a second panel being broken away to reveal the hinge assembly.

Referring to the drawings FIGS. 1 through 7, and first to FIGS. 1 though 4, A hinge assembly is generally identified as 10. The hinge assembly 10 includes a pivot means 12 and a leaf member 14. The pivot means 12 includes a pintle or pin portion 16 and at least one leg portion 18. An axis of each leg portion 18 is arrayed and disposed at an angle that is transverse to a pivot axis of the pintle portion 16 to form an L-shape, as may be seen in FIG. 2 or in an alternative U-shape as seen in FIG. 3. The pintle portion 16 and the leg portion may be bent and shaped from a single piece of a metal rod. Alternatively the pivot means 12 may be formed from multiple pieces that are fused together, by welding and the like.

Referring still to FIGS. 1 through 4, The leaf member 14 includes a knuckle portion 20 and an attaching portion 22. The knuckle portion 20 may be characterized as a tubular member or sleeve member. The knuckle portion 20 of the leaf member 14 is preferably sized for allowing its rotational controlled movement with respect to the pintle portion 16. The attaching portion 22 extends radially from the knuckle portion 20. The attaching portion 22 is sized and arrayed for attachment to a first or extension performance panel portion 24 of a performance platform 25 by a suitable means such as threaded fasteners, welding, or the like. The type of attachment would be dependent on the type of material used for the panel 24 or its support frame.

The pivot means 12 is slidably carried by a frame member 26 which supports a second or base performance panel 28 of the performance platform 25. The preferred frame member 26 includes a first leg or flange 30, a second leg or web, 32, and a guiding means 34. The guiding means 34 preferably includes a plate 35 that is welded between the first leg 30 and second leg 32. Preferably, the guiding means 34 is positioned at an angle in the neighborhood of 45 degrees with respect to the first leg 30 and at a selected distance from a corner 38. Preferably, the guiding means 34 further includes a pair of in-line through apertures 36 are formed in the corner 38 of the frame member 26 and the plate 35. Each of the through apertures 36 are sized for allowing the leg portion 18 to pass therethrough with a selected clearance of between 1.5 mm (0.0625 in.) and 3.0 mm. (0.125 in.). The length of the leg portion 18 must be sufficient for permitting full guidance thereof during full movement within the guiding means 34. Alternatively the guiding means 38 may include a tube member 40 that connects the corner 38 with the plate 35, seen more clearly in FIG. 1 and shown in dashed outline.

It is preferred that the pivoting means 12 further include a stop means 42 which limits its sliding movement, in the direction of the arrow "A", with respect to the combined guiding means 34 and the frame member 26. One non-limiting example of a stop means 42 includes a nut 44 that is selectively positioned on a threaded portion 46 of the leg portion 18. If a single nut 44 is used, it should be of the locking type for maintaining the selected stop position. The nut 44 must be larger than the through aperture 36 in the plate 35 to be effective as a stop means 42.

USE AND APPLICATION

Figure 5:
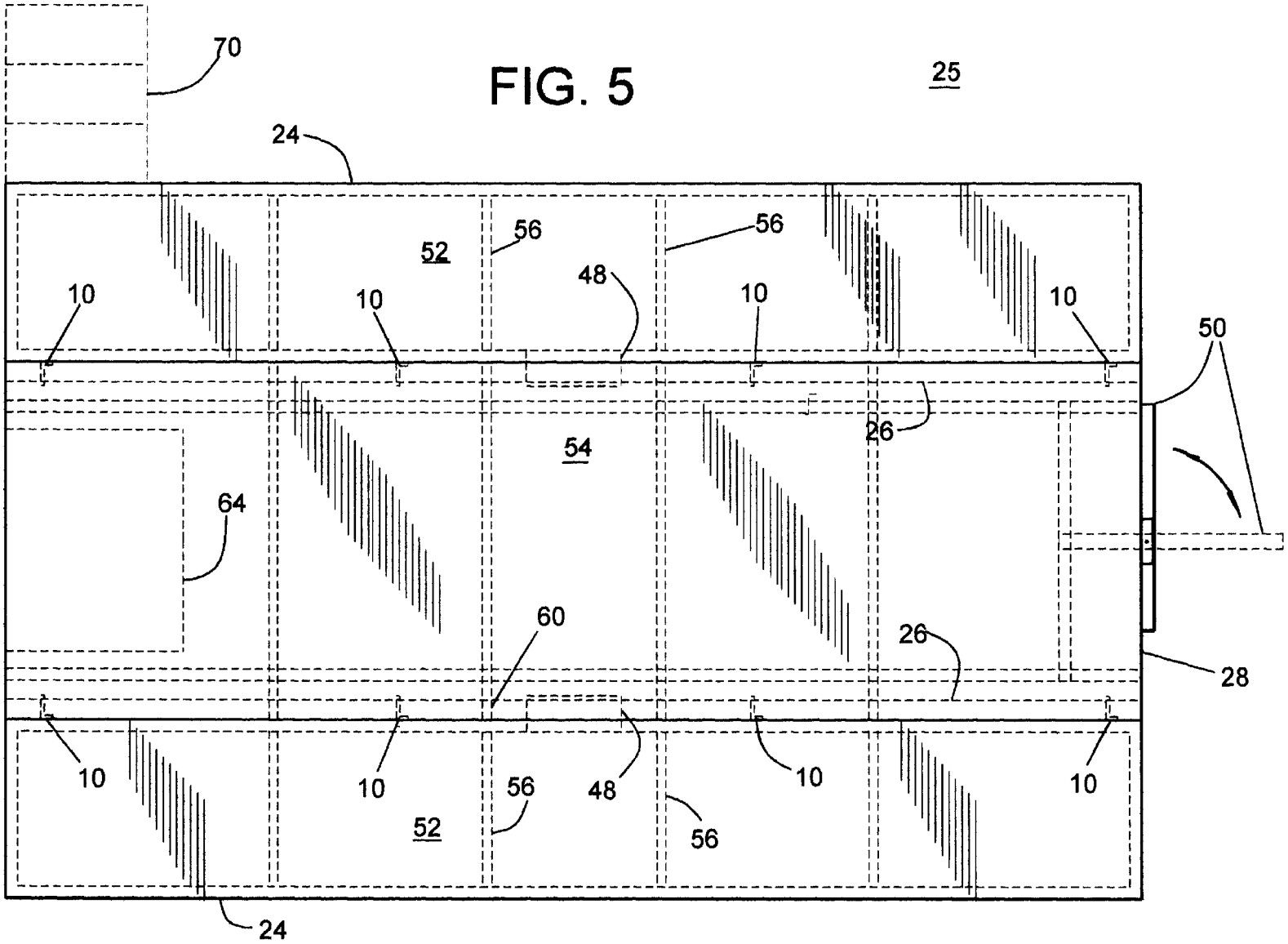
FIG. 5 represents a plan view, in a reduced scale, of a performance platform in a performance mode.

Referring now to FIGS. 1, 2, and 5 through 7, there is shown one typical example or use for the hinge assembly 10 of the present invention. This example depicts a performance platform 25 that includes a second or base performance panel 28 that is 1.53 M (5 Ft) wide by 4.88 M (16 Ft.) long. Each of the first or extension panels 24 is 0.765 M (2.5 Ft.) wide. The combination of the two extension panels with the base panel 28 provides a flat performance area of 3.06 M (10 Ft.) wide by 4.88 M (16 Ft.) long. The assembly of second panel or base performance panel 28 and its frame members 26 is depicted as being mounted on a pair of wheels 48. Preferably the wheels 48 are of the pneumatic type and are sized for allowing transport of the performance platform 25 over roads and highways. Referring to FIG. 5, it is also preferred that the performance platform 25 include a towing hitch 50 adapted for attaching to a suitable vehicle. It is preferred that the towing hitch 50 be pivotable from a stored condition, as depicted in solid outline, to a towing condition, as depicted in dashed outline.

Continuing with the description in the example above, it has been found that four hinge assemblies 10, that are equally spaced in the neighborhood of 1.53 M. (5 Ft.) apart, provide the needed support between the base panel 28 and each extension panel 24. It is also preferred that the pivot means 12 have an L-shaped configuration, as seen in FIG. 2, for use with relatively long performance platforms. The L-shape allows some relative movement of the pivot means about an axis of its leg portion 18. It has also been found that a pintle and leg diameter of 15.9 mm (0.625 in) provides the needed support and the desired results in the above example..

Figure 4:
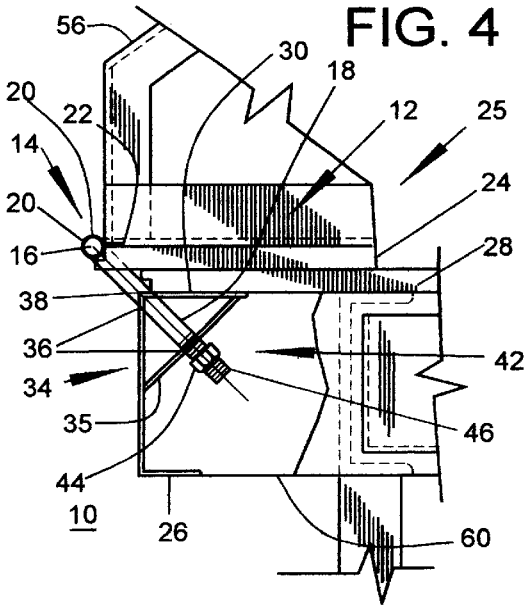
FIG. 4 represents a side elevation of the present invention and showing the hinge assembly at a second position and after an extension panel has been moved to a storage mode.
Figure 7:
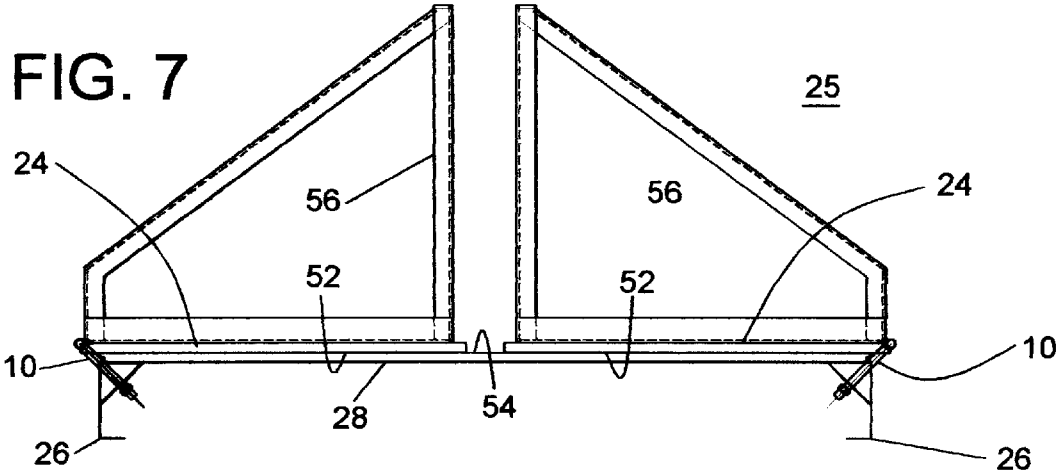
FIG. 7 represents a side elevation the performance platform. This view absent its wheels and showing the performance platform arrayed for storage and transport.

Referring in particular to FIGS. 4 and 7, typically, the performance platform 25 is moved to a site that has been selected for an event, performance or show. During the time that the performance platform is being transported, each of the first or extension performance panels 24 and its support frame 56 are positioned in a folded or pivoted array atop the base performance platform 28. The hinge assembly 10 is positioned in its second or extended condition, more clearly seen in FIG. 4. In this extended position, the leg portion 18 of the pivot means 12 has been slidably displaced within the through apertures 36 of the guiding means 34 so that a deck face 52 of the extension platform 24 rests on and abuts a deck face 54 of the base performance platform 28. The slidable displacement automatically occurs as workers pivot the platforms 24 to and towards the storage and/or transport position.

Figure 6:
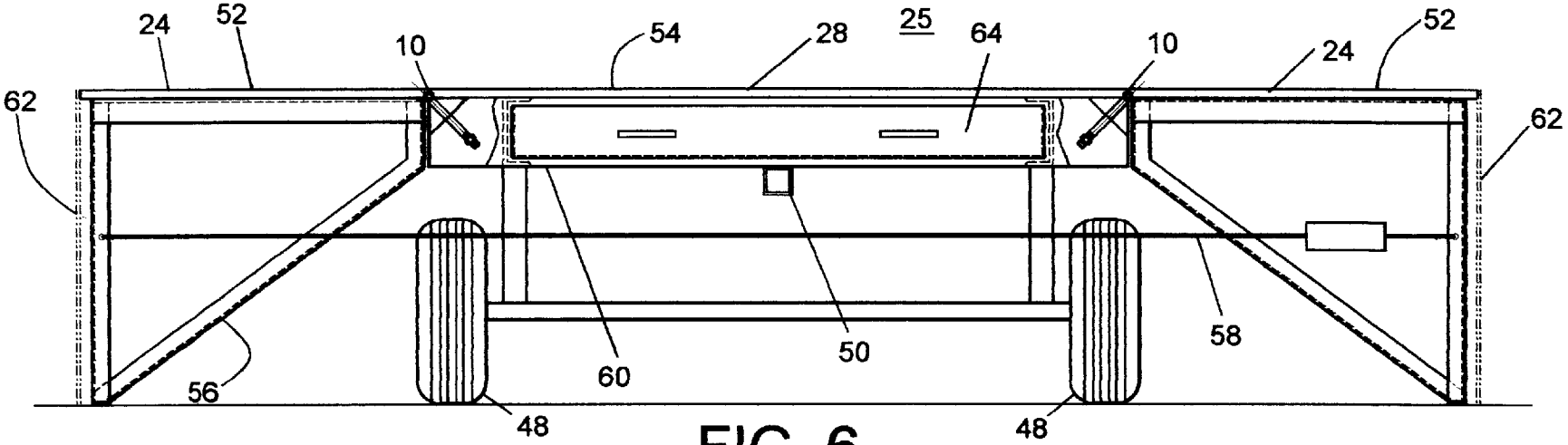
FIG. 6 represents a side elevation of one end of the performance platform, this view showing the performance platform mounted on wheels and arrayed in a performance mode.

Referring now to FIGS. 1 and 6, the performance platform 25 is depicted in its expanded or performance mode. Each of the first or extension panels 24 has been pivoted so that its support frame 56 abuts the ground or supporting surface. The support frame 56 may include adjustable feet or leveling screws for adapting to irregularities in the supporting surface. The pivot means 12 automatically slides within the guide means 34 to its first or retracted condition, as seen more clearly in FIG. 1, when and as platform 24 is moved to its performance mode. The retraction of the pivot means 12, with respect to the frame member 26, results in a substantially flush abutment of each of the extension panels 24 with the base performance panel 28. This flush abutment provides a minimal gap therebetween along the length of the panels. It is necessary to form a small locally notched area 66 for allowing the leg portion 18 to pass therethrough, in the storage mode. This notched area 66, also seen in FIGS. 2 and 7, need only be 19 mm (0.75 In) wide for the 15.9 mm diameter pivot means described above. The length of the notch 66 is dependent on the thickness of the deck panels of the performance portions 24 or 28. The notched areas 66 are relatively small and should not be a safety hazard to any performer using the performance platform. It is preferred that at least one cable 58 be attached between the support frames 56 and tensioned by a commercially available tensioning means for limiting any pivotal movement of the first panel portions 24 during a performance. If only one extension panel portion 24 is used, the cable 58 should be attached and tensioned between the main frame 60 of the base platform 28 and the support frame 56. In the performance mode, a fabric skirt 62 may be arrayed along the periphery of the performance platform 25 for decoratively covering the under structure. This skirt 62 and other accessories may be stored in a drawer section or sliding compartment 64 during storage and transport of the performance platform.

It is to be noted that a bottom surface of each of the decks of the panel portions 24 and 28 need to have locally formed recesses formed therein for the leaf member 14. The bottom surface being opposite to performance area deck faces 52 and 54 of the performance portions 24 and 28 respectively. The recesses allow the pivot axis of the pintle 16 to be in substantial alignment with a bottom surface of the panel portion 24 for proper operation.

Referring again to FIG. 5, a flight of steps 70 may be integrally attached to one of the extension panels 24 for allowing easy access to the performance decks of the performance platform 25. It is preferred that the steps 70 be mounted to the extension panel 24 by a pivoting connection for allowing compact storage thereof during the transporting of the platform. Alternatively the flight of steps 70 may be a separate assembly that may selectively located at any convenient place.

Directional terms such as "front", "back", "in", "out", downward, upper, lower and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A hinge assembly for an expandable performance platform including:

a) a pivot means that includes a pintle portion and at least one leg portion, each leg portion having its axis being disposed transverse to a pivot axis of the pintle portion;

b) a leaf member that includes a knuckle portion and an attaching portion, the knuckle portion being sized for allowing the pintle portion to closely fit therein, the attaching portion being arrayed for attaching to a first panel portion of said platform;

c) at least one frame member for supporting at least one edge of a second panel portion of said platform, the frame member including a first leg, a second leg, and a guiding means, the first leg and second leg being formed with an L-shaped cross-section, the guiding means including a guiding axis and having a predetermined guiding length and being disposed at a selected angle with respect to the first leg of the frame member for guiding said leg portion of the pivot means through an intersection of the first leg and second leg; and wherein said pivoting means being arrayed for providing a stepless and flush abutment of the first panel portion with the second panel portion when placed in a performance position, the first panel portion and second panel portion having a minimum space therebetween when placed in the performance position, the leg portion is slidably displaced along the guiding axis of the guide means from a first position to a second position when and as the first panel portion is pivoted with respect to the second panel portion to a stored position while simultaneously displacing the axis of the pintle portion thereby allowing a face of the first panel portion to abut a face of the second panel portion in the stored position.

2. An apparatus as recited in claim 1 wherein said pivot means includes a stop for limiting the displacement of the leg portion within the guide means.

3. An apparatus as recited in claim 1 wherein the first panel portion includes a support frame that is attached thereto, said support frame including at least one leg member for supporting said first panel portion in the performance position.

4. An apparatus as recited in claim 1 wherein the second panel portion is a base panel for the performance platform, that base panel is supported along its opposed edges by its associated frame member and the performance platform includes two first panel portions, each of the two first panel portions being independently hinged to the second panel portion for allowing selective pivotal movement between the performance position and the stored position.

5. An apparatus as recited in claim 3 wherein each of the first panel portion includes a support frame that is attached thereto, said support frame including at least one leg member for supporting said first panel portion in the performance position.

6. An apparatus as recited in claim 3 wherein the second panel portion and any first panel portions attached thereto are transportable.

7. An apparatus as recited in claim 6 which further includes at least two wheel assemblies and a towing hitch for transporting the performance platform by a vehicle.

8. An apparatus as recited in claim 7 wherein the towing hitch is pivotally attached thereto for placement in a stored condition when the first panel portions are placed in a performance position.

9. An apparatus as recited in claim 6 which further includes an integral storage drawer for storing any performance accessories during transporting thereof.

* * * * *